US006917164B2

(12) United States Patent
Fleury

(10) Patent No.: US 6,917,164 B2
(45) **Date of Patent: *Jul. 12, 2005**

(54) LIGHT SIGNALING DEVICE RELATED TO THE OPERATING STATE OF A SYSTEM

(75) Inventor: Christophe Fleury, Vacquiers (FR)

(73) Assignee: Airbus France, Toulouse Cedex (FR)

( * ) Notice: Subject to any disclaimer, the term of this patent is extended or adjusted under 35 U.S.C. 154(b) by 0 days.

This patent is subject to a terminal disclaimer.

(21) Appl. No.: 10/289,116

(22) Filed: Nov. 5, 2002

(65) Prior Publication Data

US 2003/0085672 A1 May 8, 2003

(30) Foreign Application Priority Data

Nov. 8, 2001 (FR) ..... 01 14445

(51) Int. Cl.[7] ..... H05B 39/10

(52) U.S. Cl. ..... 315/90; 315/129; 315/130; 315/131; 315/185 R; 315/291; 315/307; 315/308

(58) Field of Search ..... 315/291, 185 R, 315/193, 185 S, 295, 302, 307–308, 362, 90, 129–131; 362/276, 800; 340/931, 3.43, 815.45

(56) References Cited

U.S. PATENT DOCUMENTS

| | | | | | |
|---|---|---|---|---|---|
| 3,719,937 | A | * | 3/1973 | Doyle | 315/130 |
| 3,781,853 | A | | 12/1973 | Jacobs | 340/29 |
| 3,812,351 | A | * | 5/1974 | Coberley | 250/231.13 |
| 4,217,573 | A | * | 8/1980 | Norris | 340/825.25 |
| 4,271,408 | A | * | 6/1981 | Teshima et al. | 345/83 |
| 4,298,869 | A | * | 11/1981 | Okuno | 345/82 |
| 5,161,879 | A | * | 11/1992 | McDermott | 362/206 |
| 5,491,383 | A | | 2/1996 | Leiber et al. | 315/77 |
| 5,680,098 | A | | 10/1997 | Bejster et al. | 340/458 |
| 5,717,335 | A | | 2/1998 | Lee | 324/414 |
| 5,744,961 | A | | 4/1998 | Otaka | 324/403 |
| 5,786,682 | A | * | 7/1998 | Aiken et al. | 320/136 |
| 5,801,623 | A | | 9/1998 | Chen et al. | 340/458 |
| 5,896,010 | A | * | 4/1999 | Mikolajczak et al. | 315/77 |
| 6,239,716 | B1 | * | 5/2001 | Pross et al. | 340/815.4 |
| 6,351,079 | B1 | * | 2/2002 | Willis | 315/200 A |
| 6,490,512 | B1 | * | 12/2002 | Niggemann | 701/29 |
| 6,577,247 | B2 | * | 6/2003 | Giacaman | 340/907 |
| 6,608,453 | B2 | | 8/2003 | Morgan et al. | 315/312 |

FOREIGN PATENT DOCUMENTS

| | | | |
|---|---|---|---|
| DE | 1 194 295 | 6/1965 | |
| DE | 31 12038 | 2/1982 | G08B/21/00 |
| DE | 42 08306 | 9/1993 | G09G/3/14 |
| EP | 0 209 269 | 1/1987 | G08G/1/09 |

* cited by examiner

*Primary Examiner*—Thuy Vinh Tran
(74) *Attorney, Agent, or Firm*—Thelen, Reid and Priest LLP

(57) ABSTRACT

A light signaling device related to the operating state of a system has at least one light and circuits of detection of a failure of this or these lights, in which each light comprises m branches in parallel each composed of n light emitting diodes in series, and a branch selector; where m and n are integers such that m≧2 and n≧1. This invention also relates to a process for management of such device.

4 Claims, 3 Drawing Sheets

LIGHT SIGNALING DEVICE RELATED TO THE OPERATING STATE OF A SYSTEM

STATEMENT OF RELATED APPLICATION

The present application is related to co-pending U.S. patent application Ser. No. 10/289,054, filed Nov. 5$^{th}$, 2002, in the name of inventor Christophe Fleury, entitled "Process for Management of a Light Signaling Device, and a Device Using this Process, Particularly for Avionics", commonly assigned herewith. The present application claims priority from French Application No 01 14445, filed Nov. 8, 2001.

TECHNICAL FIELD

This invention relates to a light signaling device related to the operating state of a system and a process for management of such a device, particularly for avionics.

STATE OF PRIOR ART

In order to simplify the description, the following presentation is restricted to an implementation of the invention for avionics, as an example.

At the present time, many light type signaling indicators such as light emitting diodes are used in aircraft cockpits to keep pilots and possibly maintenance operators informed about the operating states of different systems present in these aircraft.

Loss of information output by this type of indicator, mainly during operation, can be difficult or even dangerous.

Therefore, pilots regularly need to make regular checks that these indicators are in good working condition by using a test command which effectively lights up a predetermined set of indicators, for example indicators in the ceiling panel. The pilots then need to replace the defective lights on line.

Thus, as illustrated on FIG. 1, a control button 12 causes simultaneous lighting of all these lights in a signaling set composed of several lights 10 controlled by signals SV1, SV2, SV3 through diodes 11, and enables the pilot to easily identify a light that remains off.

This type of set has many disadvantages, and particularly:

high consumption during the test, particularly when these lights are incandescent bulbs, impossibility of detecting a light that failed after the test, the efficiency of the test depends on the operator's vigilance.

Replacing incandescent bulbs by light emitting diodes has made it possible to extend the life of this type of indicator.

It is also known how to use lights each composed of several light emitting elements 20 in a serial/parallel circuit, as shown on FIG. 2. A failure of an element 20 then does not cause failure of the light, but simply reduces the brightness. This type of device is not really tolerant to failures, but it does have a degraded operating mode in the case of a failure.

The purpose of the invention is a light signaling device related to the operating state of a system capable of overcoming the disadvantages of devices according to prior art by detecting failures of signaling indicators and guaranteeing correct operation, even in the presence of some failures. The invention is also related to a process for management of such a device.

PRESENTATION OF THE INVENTION

This invention relates to a light signaling device related to the operating state of a system comprising at least one light and means of detection of a failure of this or these lights, characterized in that each light comprises m branches in parallel each composed of n light emitting diodes in series, and means of selecting a branch, where m and n are integer numbers such that $m \geqq 2$ and $n \geqq 1$.

Advantageously, each light comprises a light emitting set composed of m branches of n light emitting diodes connected in series and in the same direction, the first m ends of each branch being connected together, their second ends being connected to the different inputs of a selector, this selector that connects a selected branch to the output, as a function of a control order.

This device advantageously comprises the following circuits associated with each light:

a current generator that supplies powers for this light, a control module that controls the selector and a switch, this switch that is connected between the selector output and the current generator input.

Advantageously, each light and its control module and its switch are included in a single box.

This invention also relates to a process for management of a light signaling device related to the operating state of a system, comprising several lights each comprising several branches of several light elements, in which there is a step consisting of a permanent automatic test of all lights in the system.

Advantageously, the process comprises a step for dynamic management of redundancy if there is a failure in a branch of a light.

During the test step, the following steps are carried out for each light:

if the light is on, its correct operation is checked by testing the current consumed and the voltage present at its terminals, if the light is off, it is energized for a duration of the order of a few microseconds and its current/voltage parameters are measured at this instant.

During the dynamic management step, the different branches of each light are illuminated alternately at a scanning frequency of the order of a few kilohertz, the current/voltage parameters being checked in each scanning. A branch is no longer energized if a fault is observed in the branch. However, if all branches are in fault but there is at least one branch that is not in open circuit, this (these) branch(es) may be requalified as being functional.

If a fault is observed in at least one branch, the cyclic ratio for lighting other branches without a fault is modified so that the overall brightness of the light remains unchanged.

The invention may advantageously be used in avionics.

Thus, in the process according to the invention, a permanent automatic test of all lights in the cockpit of an aircraft are tested and the pilot thus no longer need to carry out this task. This type of continuous test avoids the pilot failing to detect a hidden failure. Furthermore, the redundant structure of the lights enables immediate dynamic management if there is a failure of this first redundancy without any visible repercussion by the pilot, and therefore without any additional work for him.

DETAILED DESCRIPTION OF PARTICULAR EMBODIMENTS

Figure 1:
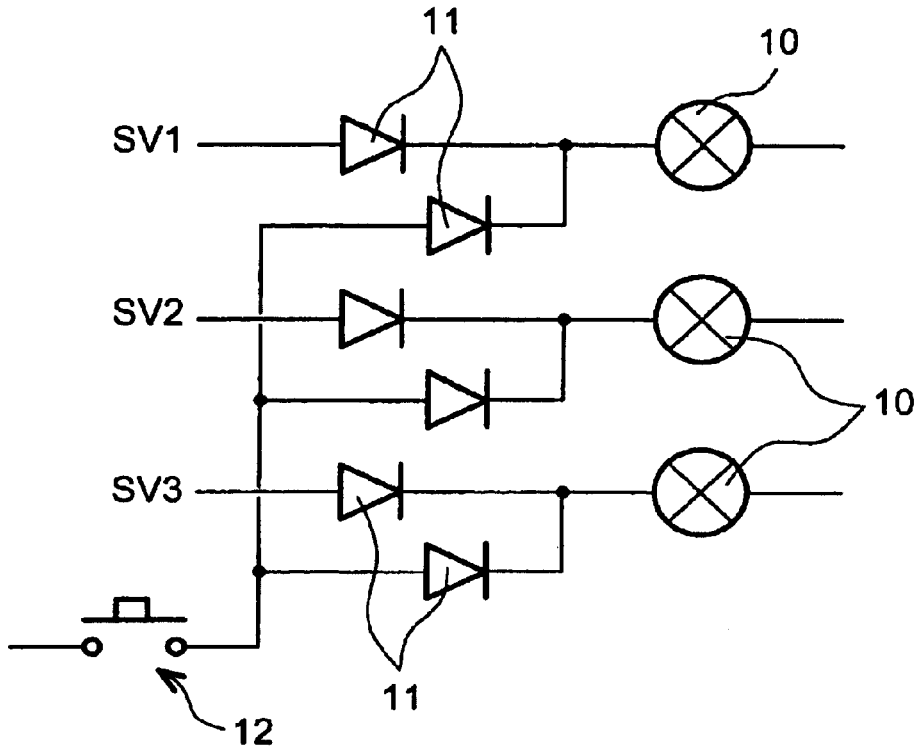
FIGS. 1 and 2 illustrate two devices according to prior art.
Figure 2:
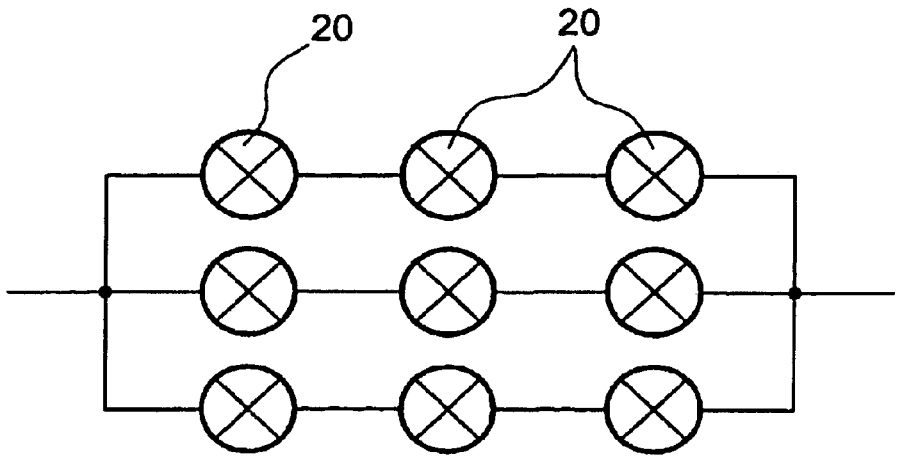
Figure 3:
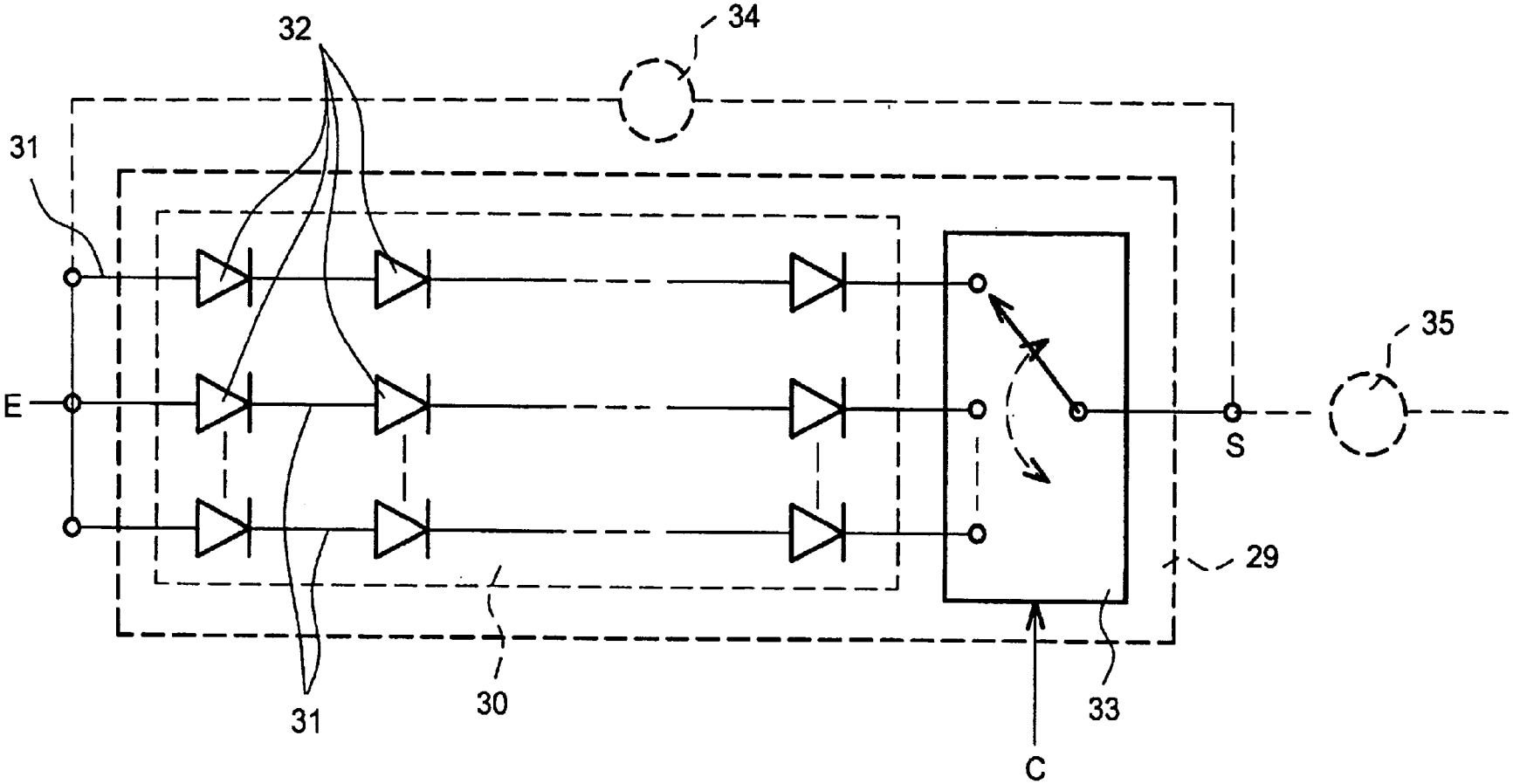
FIGS. 3 and 4 illustrate the device according to the invention.

The light signaling device according to the invention comprises at least one light 29 like that shown on FIG. 3 that comprises:

- a light emitting set 30 composed of m branches 31 of n light emitting diodes (LED) 32 (where m≧2 and n≧1), the n diodes in each branch being connected in series and in the same direction, the first m ends of these branches 31 being connected together to the input E, their second ends being connected to the different inputs of a selector 33,
- this selector 33, which connects one of the selected branches 31 to the output S, as a function of a control order C.

A voltage measurement device 34 connected between the input E and the output S of the light determines the voltage at the terminals of this light. A current measurement device 35 connected to the output of the light 29 provides information about the intensity of the current that passes through it.

Figure 4:
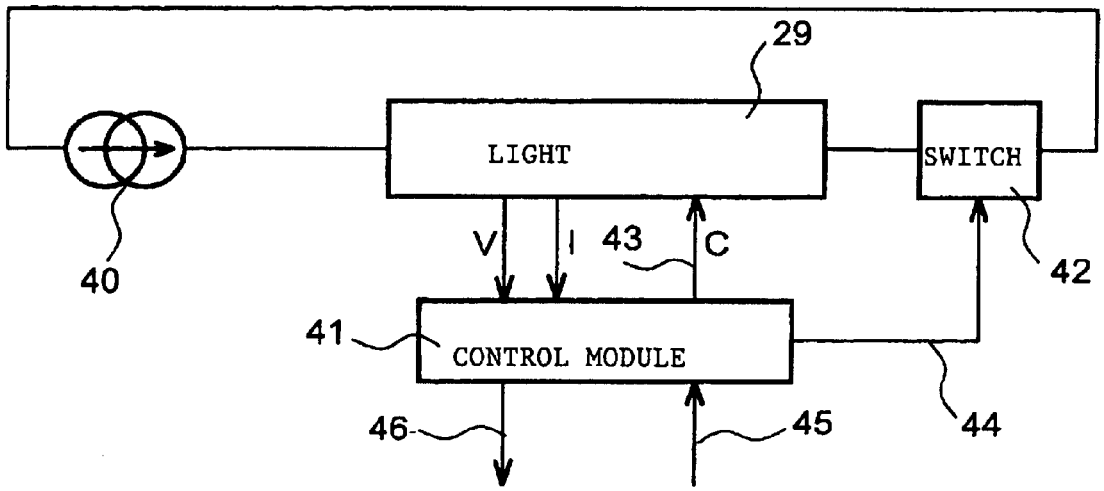

As shown on FIG. 4, the power supply for the light 29 is provided by a current generator 40. A control module 41 controls firstly the selector 33 through a line 43 and secondly a switch 42 through a line 44. This control module 41 contains a memory that stores the functional or non-functional state of each branch 31. The control signal for this module 41 transported on an outside command line 45 is a conventional order given to a light (On/Off). A report line 46 provides information about the state of this light 29, to external devices for example for alarm or maintenance purposes.

The process according to the invention carries out a dynamic test of all lights 29, for example the lights in an aircraft cockpit, such as:

- if a light is on, it is easy to check that its operating condition is correct by regularly testing the current consumed and the voltage present at these terminals,
- if a light is off, the same measurement principle is used and this light is energized for a short period. This light is then energized for a duration of the order of a few microseconds which is not perceptible to the human eye, while respecting nominal control values. The current/voltage parameters of this light are measured at this instant.

The process according to the invention also dynamically manages redundancy of each light which consist of using selector 33, and alternately selecting the different branches 31 of this light at a sufficiently high scanning frequency (of the order of a few kHz) so that it cannot be perceived by the human eye.

The current/voltage parameters of the light will be checked during each scan. If a fault is observed, the branch concerned is no longer energized and the cyclic lighting ratio for the other branches is modified so that the overall brightness of the light remains unchanged.

Thus, the process according to the invention avoids total loss of the light. Also, even when the light is not on, the process according to the invention continues its dynamic test by carrying out a short control of the different branches. As soon as a first branch is lost, a preventive maintenance message can be produced without the pilot being informed about it.

Thus, operation is as follows considering the two possible states of a light (light off or light on):

light off:

No order reaches the external control line 45. The control module 41 opens and closes the switch 42 to supply power for the light 29 by sufficiently short pulses, for example of the order of a few microseconds and at intervals such that the light 29 appears off to an observer.

Each pulse is switched in sequence by selector 33 to one of the branches 31. It is used to measure the voltage at the terminals of this branch and the current that passes through it.

Two failure cases can be detected (there are only two failure modes for a light emitting diode, namely short circuit and open circuit):

- a zero current: the circuit is open and the branch can no longer operate. It is considered as being non-functional
- a voltage lower than the nominal voltage; at least one diode is short circuited. Whether or not the branch is considered as being functional depends on the ratio between the number of diodes in good condition and the number of diodes in the branch, which is equal to the ratio between the measured voltage and the nominal voltage. The manufacturer or the user decides on the drop of efficiency at which a branch must be declared as being non-functional.

This type of "light Off" operating mode enables the control module 41 to determine which functional branches may be used in "light on" mode, before giving any order to switch the light on.

light on

A light on order arrived on the external control line 45. The control module 41 closes the switch 42 to energize the light 29 continuously. The selector 33 controlled by the signal C cyclically energizes the functional branches 31 one after the other.

For each energized branch 31, two failure cases may be detected:

- a zero current: the circuit is open and the branch can no longer operate. It is considered as being non-functional
- a voltage lower than the nominal voltage; at least one diode is short circuited. Whether or not the branch is considered as being functional depends on the ratio between the number of diodes in good condition and the number of the diodes in the branch, which is equal to the ratio between the measured voltage and the nominal voltage.

It is possible to have a degraded operating mode in which all branches are declared to be non-functional but in which there is at least one branch which is not in open circuit. In this case, the branch(es) in question may be requalified as being functional, and the light emits less light than during its nominal operation.

Any failure detection can be followed by sending a signal on the report line, that will be sent to an operator and/or any maintenance system.

Figure 5:
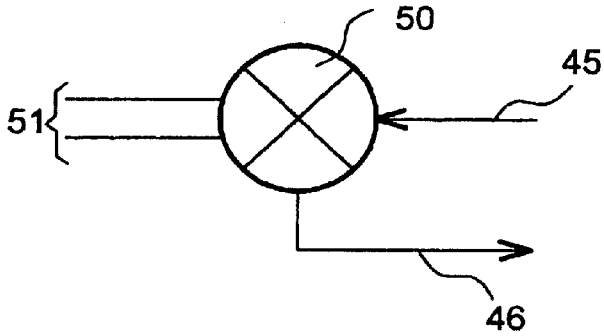
FIG. 5 illustrates an advantageous embodiment of the device according to the invention.

In one advantageous embodiment like that illustrated on FIG. 5, the light 29 and its control module 41 and the switch 42 are integrated in a single box 50 with two power supply lines 51, to present the external appearance of an almost conventional light.

What is claimed is:

1. Light signaling device related to an operating state of a system comprising:

at least one light;

means for detecting a failure of the at least one light characterized in that each light comprises m branches (31) in parallel each composed of n light emitting diodes (32) in series and in the same direction, where m and n are integer numbers such that m≧2 and n≧2;

a selector (33) connecting a selected branch (31) to an output (S) of said at least one light, as a function of a control order (C).

2. Device according to claim 1, in which each light comprises:

a light emitting set (30) composed of m branches (31) of n light emitting diodes (32) connected in series and in the same direction, first ends of these branches being connected together, second ends being connected to the different inputs of said selector (33).

3. Light signaling device related to an operating state of a system comprising:

at least one light;

means for detecting a failure of the at least one light, characterized in that each light comprises m branches (31) in parallel each composed of n light emitting diodes (32) in series and in the same direction, where m and n are integer numbers such that $m \geqq 2$ and $n \geqq 2$;

a selector (33) connecting a selected branch (31) to an output (S) of said at least one light, as a function of a control order (C), wherein each light comprises:

a light emitting set (30) composed of m branches (31) of n light emitting diodes (32) connected in series and in the same direction, first ends of these branches being connected together, second ends being connected to the different inputs of said selector (33);

a current generator (40) for supplying power to the light (29); and a control module (41) for controlling the selector (33) and a switch (42) and containing a memory in which a state of each branch (31) is stored, the switch (42) is connected between an output from the selector (33) and an input from the current generator (40).

4. Light signaling device related to an operating state of a system comprising:

at least one light;

means for detecting a failure of the at least one light, pharacterized in that each light comprises m branches (31) in parallel each composed of n light emitting diodes (32) in series and in the same direction, where m and n are integer numbers such that $m \geqq 2$ and $n \geqq 2$;

a selector (33) connecting a selected branch (31) to an output (S) of said at least one light, as a function of a control order (C).

wherein each light comprises:

a light emitting set (30) composed of m branches (31) of n light emitting diodes (32) connected in series and in the same direction, first ends of these branches being connected together, second ends being connected to the different inputs of said selector (33);

a current generator (40) for supplying power to the light (29);

a control module (41) for controlling the selector (33) and a switch (42) and containing a memory in which a state of each branch (31) is stored; and the switch (42) is connected between an output from the selector (33) and an input from the current generator (40), wherein each light (29), the control module (41) and the switch (42) are integrated into a single box (50).

* * * * *